US005610877A

United States Patent [19]

Adams et al.

[11] Patent Number: 5,610,877

[45] Date of Patent: Mar. 11, 1997

[54] FABRIC ATTACHABLE TIMEPIECE

[76] Inventors: Kathy S. Adams, 8213 Oak Leaf Ct., Raleigh, N.C. 27615; Michael J. Knowles, 2861 Sky Dr., Fayetteville, N.C. 28303

[21] Appl. No.: 375,787

[22] Filed: Jan. 20, 1995

[51] Int. Cl.[6] ..... G04B 37/00

[52] U.S. Cl. ..... 368/10; 368/88; 368/316; 368/278

[58] Field of Search ..... 368/281, 316, 368/10, 278, 88, 280

[56] References Cited

U.S. PATENT DOCUMENTS

| | | |
|---|---|---|
| D. 270,244 | 8/1983 | McCormick . |
| D. 292,677 | 11/1987 | Jordi . |
| D. 313,758 | 1/1991 | Klose . |
| D. 313,759 | 1/1991 | Nomizu . |
| D. 322,762 | 12/1991 | Muller . |
| 2,333,428 | 11/1943 | Kinsey . |
| 3,492,809 | 2/1970 | Gisiger-Lusa . |
| 4,705,408 | 11/1987 | Jordi . |
| 5,035,000 | 7/1991 | Matthias . |

FOREIGN PATENT DOCUMENTS

| | | | |
|---|---|---|---|
| 3143546 | 6/1983 | Germany . | |
| 60883 | 4/1912 | Switzerland | 368/276 |
| 680327 | 8/1992 | Switzerland . | |

*Primary Examiner*—Bernard Roskoski

*Attorney, Agent, or Firm*—Baker, Donelson, Bearman & Caldwell

[57] ABSTRACT

This invention is a timepiece mounted within a case with a separate flexible backing that has a plurality of outwardly projecting fingers with upwardly turned lips at the ends thereof. The case is placed on a piece of fabric such as the sleeve of a shirt. The backing is placed on the other side of the fabric with the stem of the timepiece outwardly projecting between the fingers of the base portion. By pressing the base portion and the timepiece case together grips the fabric to mount the timepiece on such fabric. The timepiece can be removed from the fabric by simply pressing at least part of the lips outwardly to disengage the same through the fabric from the case within the timepiece is mounted.

8 Claims, 2 Drawing Sheets

FABRIC ATTACHABLE TIMEPIECE

FIELD OF INVENTION

This invention relates to timepieces and more particularly to the mounting of timepieces for ready observance.

BACKGROUND OF INVENTION

A majority of the timepieces used today are wrist watches. For normal use, the wrist mounted watch is adequate for its intended purpose. There are, however, certain occasions when the wearing of a wrist watch to tell time is either inconvenient, impractical or even unsafe.

Some examples of the above include dentists, hygienists, doctors, and nurses who wear laytex gloves when coming into contact with patients which makes the wearing of a wrist watch inconvenient. When the same personnel wear long sleeved medical gowns, the observance of a wrist watch is completely obscured so the same is useless for determining time. In working around machinery and in numerous other similar environments, the wearing of a wrist watch can become extremely dangerous for a mirad of reasons.

The use of pocket watches in the various environments discussed above is usually impractical due to the difficulty and time required to remove the watch from a pocket and observe the same.

Various clip-on timepieces have been disclosed but these are usually relatively heavy and awkward to use. They tend to be loosely mounted which at best is a nuisance and at worst can be dangerous by coming into contact with machinery, etc. These clip-on timepieces also can be easily disengaged from the material supporting the same.

In the various situations discussed above, it is quite often very desirable that the user of the timepiece be able to readily determine the time without having to look up at a wall clock, pull down protective gloves, or pull up protective sleeves.

CONCISE EXPLANATION OF REFERENCES

German Patent DE-31 43546 A1 is considered of interest in that it discloses an electronic watch broach that is U-shaped with two arms connected resiliently by a bend so that they grip material of a garment.

U.S. Pat. No. 4,705,408 to Urs M. Jordi as well as U.S. Design Nos. DES 292,677 to Urs M. Jordi, DES 313,758 to Odo H. Klose and DES 313,759 to Hidekatsu Nomizu are all considered of interest in that they disclose additional watch structures of the clip-on type.

U.S. Pat. No. 3,492,809 to Armin Gisiger-Lusa is considered of interest in that it discloses a watch mounted on a flexible wrist band to eliminate the conventional horn or bow elements on the watch case.

U.S. Pat. No. DES 270,244 to James F. McCormick is considered of interest in that it discloses a digital watch case that snaps together, apparently with the watch mechanism being disposed within such case.

U.S. Pat. Nos. 2,333,428 to Herbert L. Kinsey and 5,035,000 to Jan H. Matthias are both considered of interest in that they disclose watches that are mounted on the cuff of garments.

Finally, Liechtenstein Patent Number CH 680327 G A3 is considered of interest in that it discloses a watch that is attached to a support such as a small key or a strap.

BRIEF DESCRIPTION OF INVENTION

After much research and study into the above mentioned problems, the present invention has been developed to provide a timepiece that can be easily attached to and removed from fabric such as clothing, protective dental and medical gowns, and the like. This timepiece can be placed in any convenient location such as the sleeve of the user so that such user can easily read the time.

The above is accomplished through the provision of a timepiece within a case with a separate flexible backing that has a plurality of outwardly projecting fingers. The case in which the timepiece is mounted is placed at the desired location on the fabric. The backing is placed on the other side of the fabric with the finger engaging the timepiece case with the fabric therebetween. This arrangement gives a very tight grip for mounting of the timepiece on the fabric but does not require the bulky clips and the like shown in the prior art.

The present invention can be used by dentists and doctors when wrist watches are impractical as well as on casual wear or on any other location where a fabric mounted timepiece would be desirable.

In view of the above it is an object of the present invention to provide a relatively light weight timepiece that is universally mountable on fabric type material.

Another object of the present invention is to provide a timepiece within a case with a specially adapted backing for gripping fabric between the backing and the case.

Another object of the present invention is to provide a backing having a plurality of fingers for engaging the case of a timepiece for mounting the same on sheet like material such as fabric.

Another object of the present invention is to provide a timepiece with a backing that is readily maneuverable around the watch stem or other projections extending outwardly from the watch case.

Another object of the present invention is to provide a fabric attachable timepiece that is of the light weight quartz type with a light weight plastic case and backing.

Other objects and advantages of the present invention will become apparent and obvious from the study of the following description and accompanying drawings which are merely offsets of the present invention.

DETAILED DESCRIPTION OF INVENTION

Figure 1:
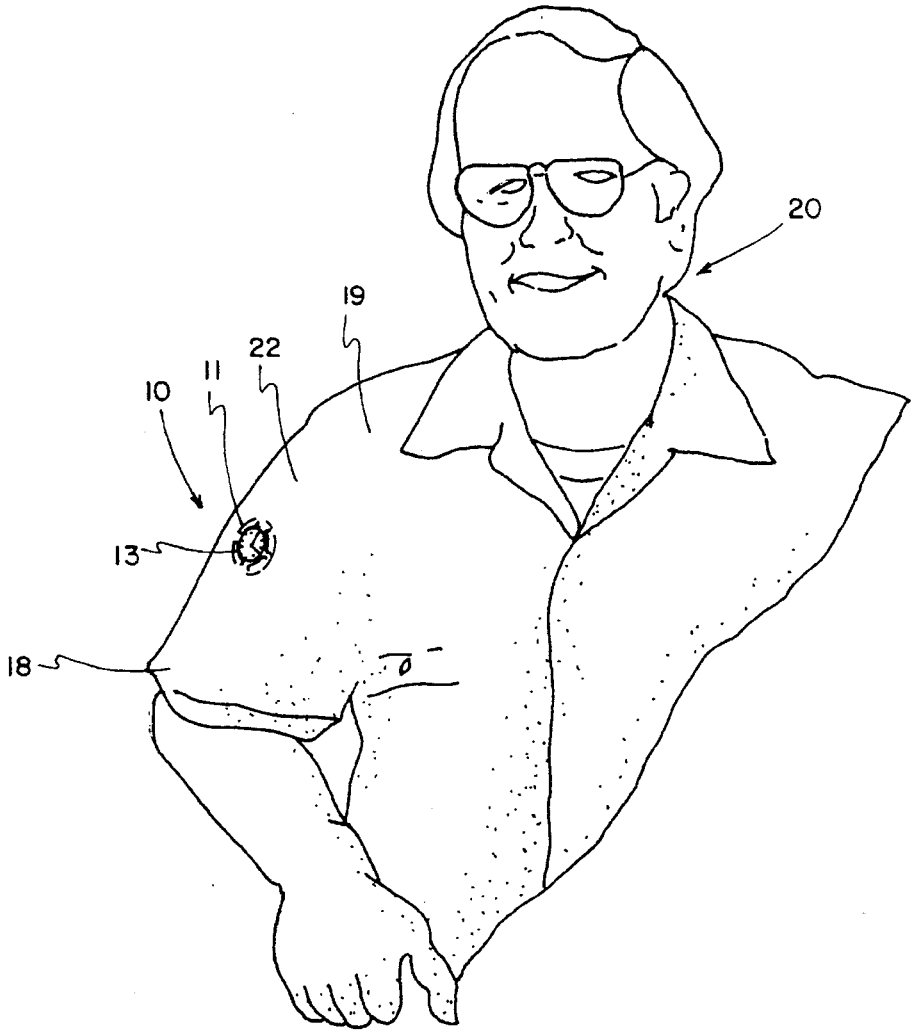
FIG. 1 is a perspective view of the fabric attachable timepiece of the present invention mounted on the shirt sleeve of the user thereof.
Figure 2:
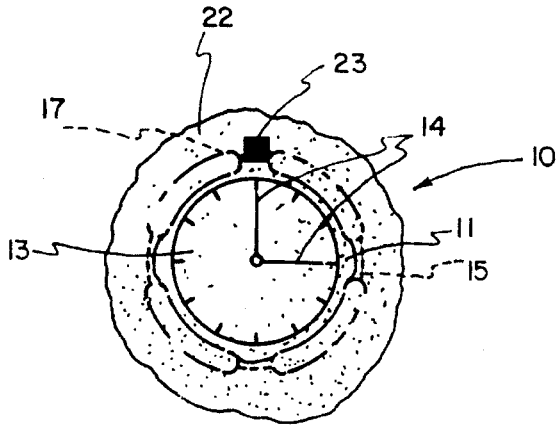
FIG. 2 is an enlarged view of the timepiece shown in FIG. 1.
Figure 3:
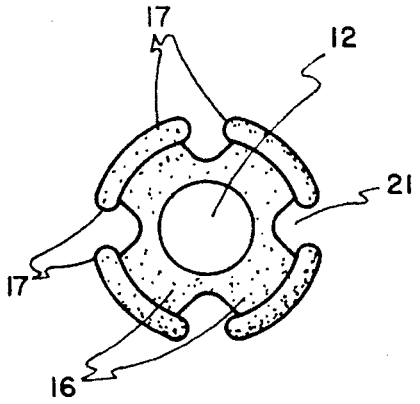
FIG. 3 is a front elevational view of the backing member of the present invention.
Figure 4:
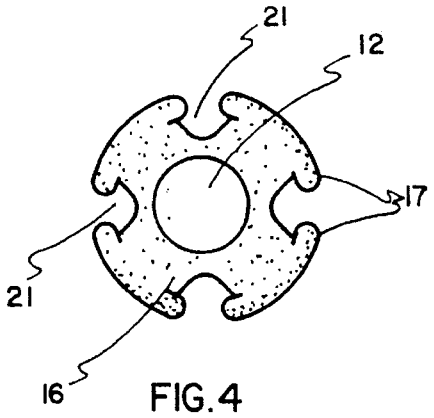
FIG. 4 is a rear elevational view thereof.
Figure 5:
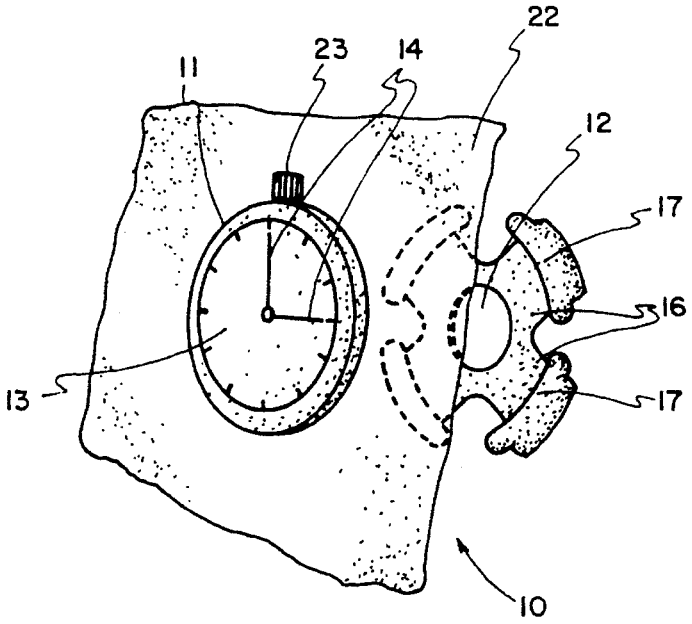
FIG. 5 is an exploded view of the timepiece, the mounting fabric and the backing member.

With further reference to the drawings, the fabric attachable timepiece of the present invention, indicated generally at 10, includes a case portion 11 and a backing portion 12. A timepiece 13 is operatively mounted in a case portion 11. This timepiece includes time indicating indicia 14 which can be either hands and hour markings or other means such as a digital readout display. Since timepieces are well known those skilled in the art, further detailed discussion of this portion of the present invention is not deemed necessary.

A watch stem or other means for setting the timepiece is indicated at 15.

The backing portion 11 of the present invention 10 is formed preferably from a light weight plastic or similar material with a memory. A plurality of outwardly projecting fingers 16 are provided with curved case engaging lips 17 formed on the outer ends thereof. The fingers 16 and lips 17 of backing portion 12 are adapted to engage case 11 snugly when a fabric material is disposed therebetween. Conversely, if the backing 12 is snapped onto the case 11 without having fabric therebetween, there is engagement but not as snug as when the case of the present invention is mounted on a fabric like material.

To use the fabric attachable timepiece of the present invention, the same is placed at any desired location such as on one side of the fabric 22 of the sleeve 18 of shirt 19 worn by user, indicated generally at 20. The backing portion 12 is then placed on the opposite side of fabric 22 so that one of the gaps or spacing 21 between the lips 17 of fingers 16 can be readily aligned with the stem 22 that is used in setting the timepiece 13. The backing 12 is then pressed against the case 11 so that the lips 17 will engage the periphery 15 of the case 11 with the fabric 22 of the sleeve or other mounting material disposed snugly between the case and backing.

To remove the backing portion 12 from the case portion 11 to remove the timepiece 13 from the fabric 22, two adjoining lips 17 are pressed through the fabric 22 outwardly to release the case portion 11 from the grip of the lips.

From the above it can be seen that the present invention provides a light weight fabric attachable timepiece that can be readily attached and detached from fabric. Additionally, when the timepiece is mounted on the fabric it is firmly held in place by the backing portion and cannot easily be removed therefrom.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A fabric mountable timepiece which comprises:

a case having a periphery and a timepiece operatively mounted therein, said timepiece having a stem which extends outwardly from the periphery of said case; and a backing portion formed from a light-weight, flexible material having a memory, said backing portion having at least two outwardly projecting fingers which define a space for receiving the stem of said timepiece; said fingers being provided with case-engaging lips formed on the outer ends thereof to engage said case snugly when a fabric material is disposed between the case and the backing portion.

2. A timepiece according to claim 1 wherein said backing portion comprises at least four outwardly projecting fingers.

3. A timepiece according to claim 1 wherein said flexible material is plastic.

4. A fabric mountable timepiece which comprises:

a case having a periphery;

a timepiece having a stem which extends outwardly from the periphery of said case, said timepiece being operatively mounted within said case; and a backing portion having at least two outwardly projecting fingers which define a slot for receiving the stem of said timepiece when the case containing said timepiece is positioned within said backing portion, said fingers being adapted to engage said case snugly when a fabric material is disposed between the case and the backing portion.

5. A timepiece according to claim 4 wherein the distal ends of said outwardly projecting fingers are provided with case engaging lips for securing said case within the backing portion.

6. A timepiece according to claim 4 wherein said backing portion comprises at least four outwardly projecting fingers.

7. A timepiece according to claim 4 wherein said backing portion is formed from a flexible material having a memory.

8. A timepiece according to claim 7 wherein said flexible material is plastic.

* * * * *